US008807278B1

(12) United States Patent
Galloway et al.

(10) Patent No.: US 8,807,278 B1
(45) Date of Patent: Aug. 19, 2014

(54) HUNTING STAND APPARATUS

(76) Inventors: Kevin S. Galloway, Salem, SC (US); David E. Johnson, Salem, SC (US)

( * ) Notice: Subject to any disclaimer, the term of this patent is extended or adjusted under 35 U.S.C. 154(b) by 33 days.

(21) Appl. No.: 13/244,385

(22) Filed: Sep. 24, 2011

(51) Int. Cl.
*E06C 1/12* (2006.01)

(52) U.S. Cl.
USPC ..... 182/115; 182/116; 182/124; 182/194; 182/195

(58) Field of Classification Search
USPC ..... 182/195, 115, 116, 124, 194
See application file for complete search history.

(56) References Cited

U.S. PATENT DOCUMENTS

| | | | | | |
|---|---|---|---|---|---|
| 4,061,202 | A | | 12/1977 | Campbell | |
| 4,552,246 | A | * | 11/1985 | Thomas | 182/116 |
| 4,552,247 | A | | 11/1985 | Purdy | |
| 4,579,198 | A | * | 4/1986 | Lee | 182/115 |
| 4,592,446 | A | * | 6/1986 | White | 182/93 |
| 4,742,888 | A | * | 5/1988 | Amacker | 182/116 |
| 4,787,476 | A | * | 11/1988 | Lee | 182/116 |
| 4,989,692 | A | * | 2/1991 | Min | 182/166 |
| 5,064,020 | A | * | 11/1991 | Eagleson | 182/20 |
| 5,105,908 | A | * | 4/1992 | Freund | 182/20 |
| 5,195,611 | A | * | 3/1993 | Untz | 182/187 |
| 5,253,732 | A | * | 10/1993 | Daniels | 182/116 |
| 5,275,257 | A | | 1/1994 | Robertson | |
| 5,332,063 | A | * | 7/1994 | Amacker | 182/116 |
| 5,564,524 | A | * | 10/1996 | Thaggard et al. | 182/116 |
| 5,738,186 | A | * | 4/1998 | Jones | 182/195 |
| D396,303 | S | | 7/1998 | Odom et al. | |
| 5,791,436 | A | | 8/1998 | Talley, Sr. | |
| 6,053,278 | A | * | 4/2000 | Myers | 182/20 |
| 6,199,660 | B1 | | 3/2001 | Meeks | |
| 6,505,707 | B1 | * | 1/2003 | Berry | 182/20 |
| 6,520,291 | B2 | * | 2/2003 | Andrey | 182/116 |
| 2009/0223742 | A1 | * | 9/2009 | LePage | 182/123 |

* cited by examiner

*Primary Examiner* — Alvin Chin Shue
*Assistant Examiner* — Colleen M Chavchavadze

(57) ABSTRACT

A hunting stand apparatus includes a pair of posts each having a bottom end and a top end. Each of the posts is telescoping and includes a same number of a plurality of tubular members such that sets of tubular members are defined. Each of a plurality of rungs is attached to and extending between tubular members of each set. A plurality of locking members is provided for locking the sets in an extended position. A seat has a front edge pivotally coupled to an upper most one of the rungs. A pair of brackets is also provided. Brackets are attached to each of the posts. Each of a pair of supports is removably attached to and extends between one of the brackets and a back edge of the seat such that the seat is angled with respect to the posts.

8 Claims, 5 Drawing Sheets

HUNTING STAND APPARATUS

BACKGROUND OF THE INVENTION

1. Field of the Invention

The present invention relates to hunting stand devices and more particularly pertains to a new hunting stand device for providing a support and sitting area for a hunter adjacent to a tree and above a ground surface.

2. Description of the Prior Art

The use of hunting stand devices is known in the prior art. U.S. Pat. No. 4,061,202 describes a hunting stand consisting of a collapsible pole having an upper end with hooks for engaging a tree and which includes a plurality of steps attached to and extending laterally away from the pole. Another type of hunting stand device is U.S. Pat. No. 5,791,436 having a plurality of ladder sections that are removably attachable together for forming a climbing member having an upper end forming a seat. Yet another such device is found in U.S. Pat. No. 6,199,660 which includes a ladder having an upper end defining a seat on which a hunter may sit.

While these devices fulfill their respective, particular objectives and requirements, the need remains for a device that allows the hunter to selectively adjust a height of a tree stand and which readily collapses into a relatively small assembly for easy transportation into and out of a forest. The device should also include a collapsible seat and footrest for the comfort of a person using the device.

SUMMARY OF THE INVENTION

The present invention meets the needs presented above by generally comprising a pair of posts, each of the posts has a bottom end and a top end. Each of the posts is telescoping and includes a same number of a plurality of tubular members such that sets of tubular members are defined each including one tubular member from each the posts. Each of a plurality of rungs is attached to and extends between the posts so that each of rungs is attached to and extending between one of the sets. A plurality of locking members is provided for locking adjacent ones of the sets of tubular members in an extended position. A seat has a front edge, a back edge and a pair of side edges. The front edge is pivotally coupled to an upper most one of the rungs. The seat is extendable rearward of the posts. A pair of brackets is also provided. Brackets are attached to each of the posts and are positioned nearer the top ends than the bottom ends of the posts. Each of a pair of supports is removably attached to and extends between one of the brackets and the back edge of the seat such that the seat is angled with respect to the posts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
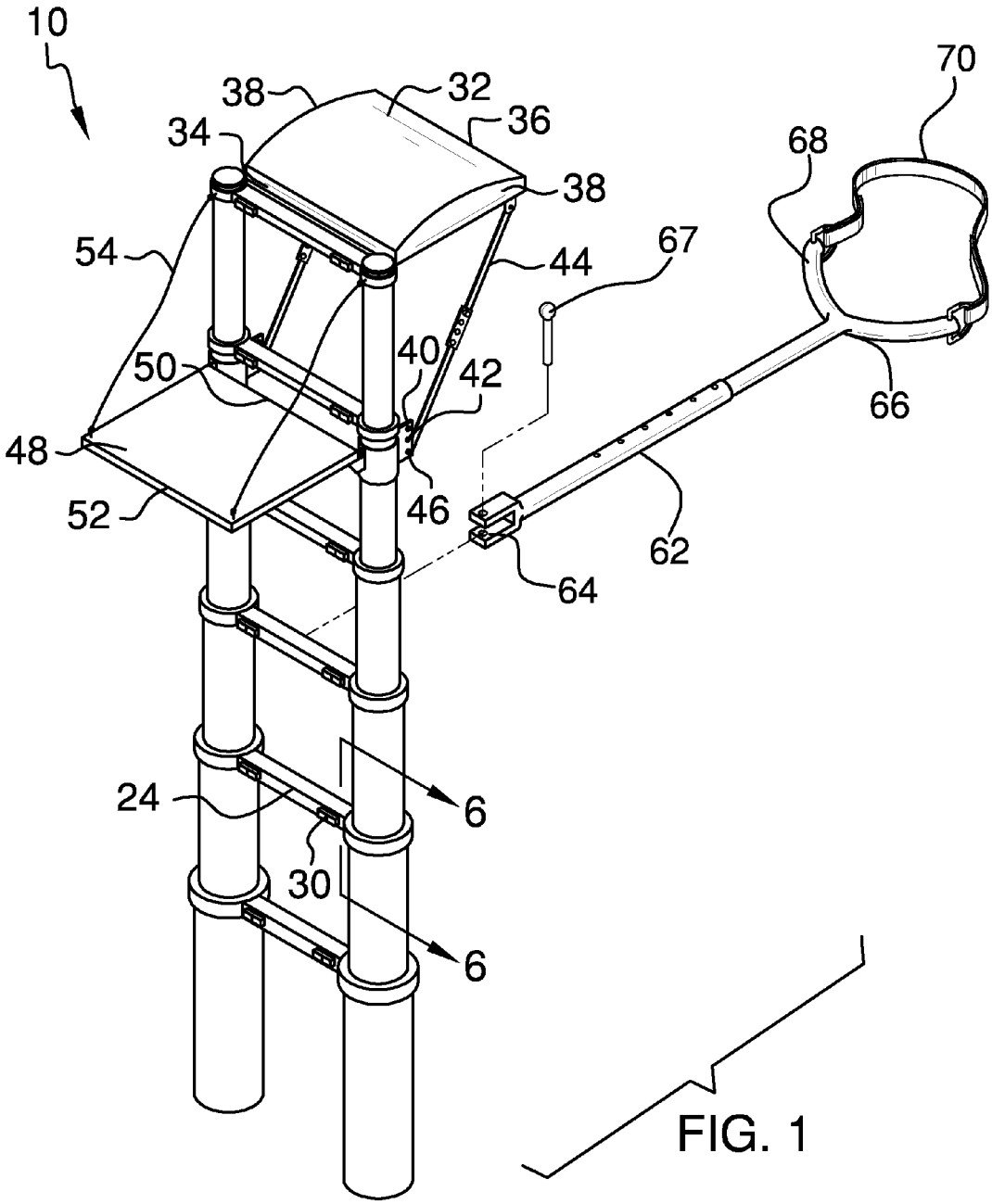
FIG. 1 is a perspective view of a hunting stand apparatus according to the present invention.
Figure 3:
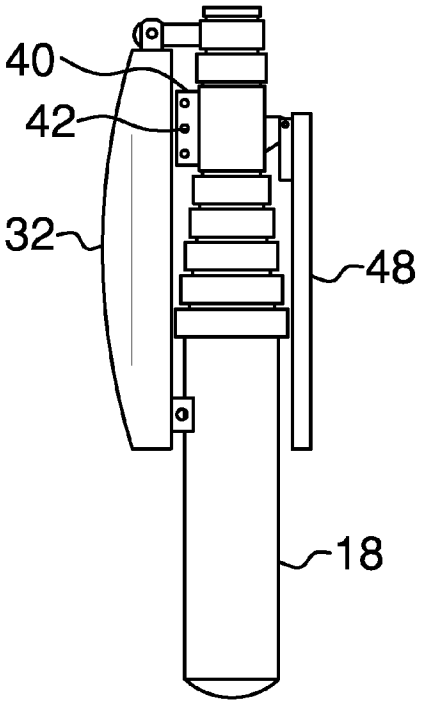
FIG. 3 is a collapsed side view of the present invention.
Figure 2:
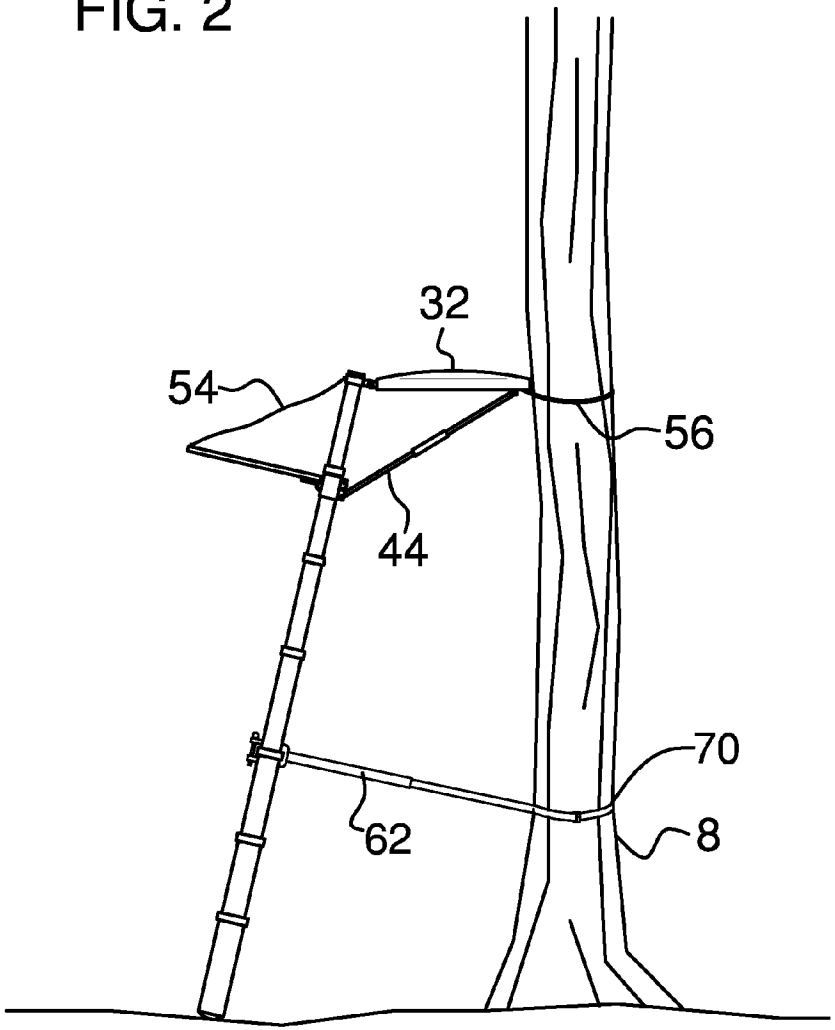
FIG. 2 is a side in-use view of the present invention.

With reference now to the drawings, and in particular to FIGS. 1 through 7 thereof, a new hunting stand device embodying the principles and concepts of the present invention and generally designated by the reference numeral 10 will be described.

As best illustrated in FIGS. 1 through 7, the hunting stand apparatus 10 generally comprises a pair of posts 12. Each of the posts 12 has a bottom end 14 and a top end 16. The posts 12 are each telescoping and include a plurality of tubular members 18 slidably extendable into and out of each other. Each of the tubular members 18 has a decreasing diameter from the bottom end 14 to the top end 16 so that the posts 12 may be collapsed downwardly from the top end 16 to the bottom end 14. Each of the tubular members 18 has a lower end 20 and an upper end 22. The posts 12 each have a same number of the tubular members 18 so that sets of tubular members 18 are defined each including one tubular member 18 from each the posts 12. The posts 12 preferably have an upper height of between 11 feet and 14 feet and a collapsed height of less than 3 feet.

A plurality of rungs 24 is provided. Each of the rungs 24 is attached to and extends between the posts 12 so that each of rungs 24 is attached to and extends between one of the sets of tubular members 18. Each of the rungs 24 is positioned adjacent to a respective one of the upper ends 22. The rungs 24 each have a length generally between 18 inches and 36 inches.

Figure 6:
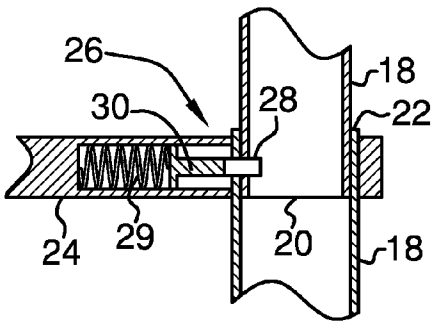
FIG. 6 is a cross-sectional view of the present invention taken along line 6-6 of FIG. 1.
Figure 5:
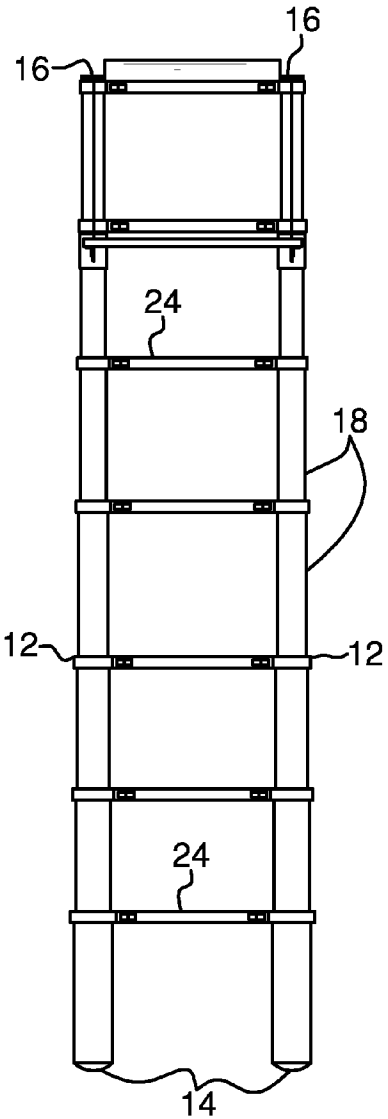
FIG. 5 is a front view of the present invention.
Figure 7:
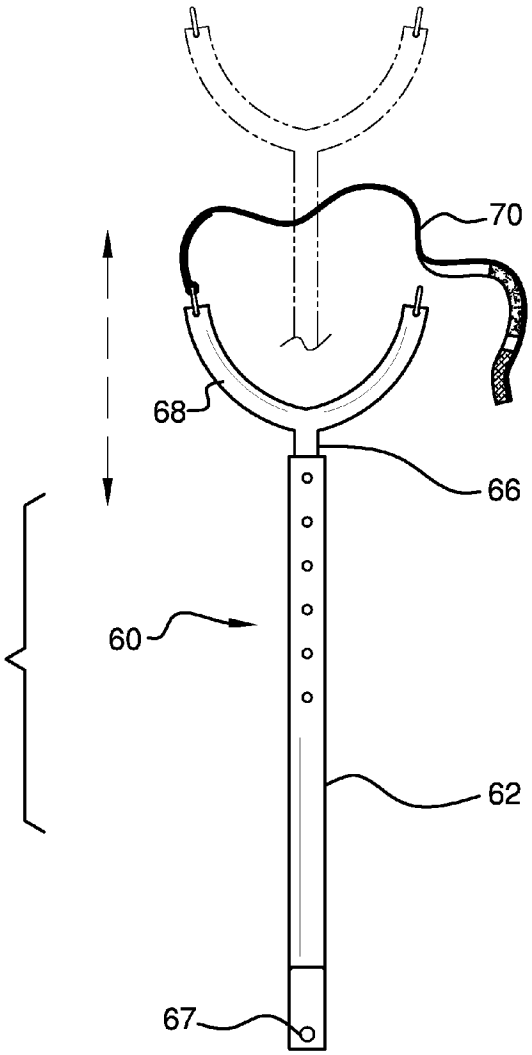
FIG. 7 is a top view of stabilizing assembly of the present invention.

A plurality of locking members 26 is also provided. Each of the locking members 26 releasably locks adjacent ones of the sets of tubular members 18 in an extended position, such as is shown in FIG. 1. Each of the locking members 26 is positioned on one of the rungs 24. The locking members 26 each include a pair of rods 28 biased outwardly from opposite ends of a corresponding one of the rungs 24 and into a respective one of the sets of tubular members 18 by a biasing member 29 which is preferably a spring. Each of the rods 28 is removably extendable into a next upper one of the tubular members 18 when the next upper one of the tubular members 18 is placed in an extended position as shown in FIG. 6. Actuators 30 attached to each of the rods 28 extend outwardly of the rungs 24 for allowing a person to disengage the rods 28 from the tubular members 18.

A seat 32 has a front edge 34, a back edge 36 and a pair of side edges 38. The front edge 34 is pivotally coupled to an upper most one of the rungs 24 adjacent to the top ends 16. The seat 32 is extendable rearward of the posts 12. A pair of brackets 40 is provided. Each of the brackets 40 is attached to one of the tubular members 18 nearer to the top end 16 than the bottom end 14 of the posts 12. Preferably, the brackets 40 are positioned adjacent to one of said rungs 24 positioned adjacent and below the upper most one of the rungs 24. The brackets 40 each include a plate having a plurality of apertures 42 extending therethrough. Each of a pair of supports 44 is removably attached to and extends between one of the brackets 40 and the back edge 36 of the seat 32 so that the seat 32 is angled with respect to the posts 12. The supports 44 are selectively attachable to the desired aperture 42 with fasteners 46 to select an appropriate angle for the seat 21 and it is preferred that the supports 44 themselves have adjustable length.

A footrest 48 includes a rearward edge 50 and a forward edge 52. The rearward edge 50 is hingedly coupled to the posts 12 and is extendable forward of the posts 12. The footrest 48 is positioned nearer to the top end 16 and the bottom end 14. A pair of tethers 54 is attached to the footrest 48 and is removably attached to the top ends 16 so that the footrest 48 extends outwardly from the posts 12.

The apparatus 10 may include a stabilizing member 60 for further stabilizing the apparatus 10. The stabilizing member 60 includes an elongated member 62 that has a first end 64 and a second end 66. The first end 64 comprises a securing member that receives one of the rungs 24. A pin 67 is extended through the securing member, or first end 64, to retain the securing member on the rungs 24. An arcuate member 68 is attached to the second end 66 and is abuttable against a tree 8. A tie 70 is securable to opposite ends of the arcuate member 68 and extended around the tree 8 to releasably secure the arcuate member 68 to the tree 8. The elongated member 62 is telescopic to allow selective adjustment of a length of the elongated member 62.

Figure 4:
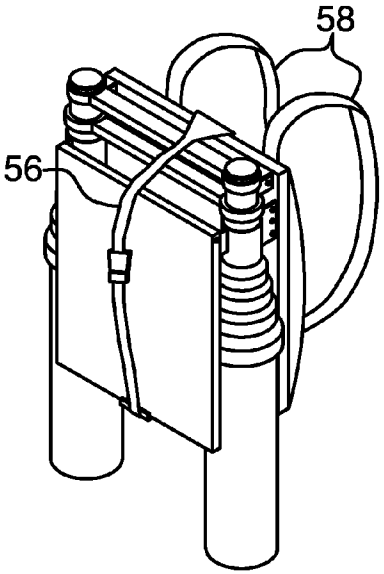
FIG. 4 is a perspective view of the present invention.

In use, the rungs 24 are separated, as needed, in order to provide the appropriate height needed by a hunter. The back edge 36 of the seat 32 is then abutted against the tree 8 and a strap 56 is used to secure the apparatus 10 to the tree 8. The strap 56 may also be used to hold the rungs 24 together in a stored position as shown in FIG. 4. Also, as shown in FIG. 4, shoulder straps 58, may be attached to the seat 32 of the apparatus 10 for allowing easier transporting of the apparatus 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A collapsible hunting stand assembly comprising:

a ladder including a pair of posts, each of said posts having a bottom end and a top end, each of said posts being telescoping and including a plurality of tubular members, each of said posts having a same number of said tubular members such that sets of tubular members are defined each including one tubular member from each said posts;

said ladder further including a plurality of rungs, each of said rungs being attached to and extending between said posts such that each of rungs is attached to and extending between one of said sets;

a plurality of locking members, each of said locking members locking adjacent ones of said sets of tubular members in an extended position;

a seat having a front edge, a back edge and a pair of side edges, said front edge being pivotally coupled to said ladder, said seat being extendable rearward of said posts, said posts each having a longitudinal axis, a plane being defined being parallel to and including each said longitudinal axis, said seat being positioned completely rearward of said posts and said plane when said seat is oriented perpendicular to said posts;

a pair of brackets, each of said brackets being attached to one of said posts and being positioned nearer the top ends than the bottom ends of the posts;

a pair of supports, each of said supports being removably attached to and extending between one of said brackets and said back edge of said seat such that said seat is angled with respect to said post; and a footrest including a rearward edge and a forward edge, said rearward edge being hingedly coupled to said posts and being extendable forward of said posts, said footrest being spaced from said supports such that said posts are positioned between said footrest and said supports, an entirety of said footrest being positioned forward of said posts and said plane when said footrest is oriented perpendicular to said posts.

2. The assembly according to claim 1, wherein each of said tubular members having a decreasing diameter from said bottom end to said top end.

3. The assembly according to claim 1, wherein each of said tubular members having a lower end and an upper end, each of said rungs being positioned adjacent to a respective one of said upper ends.

4. The assembly according to claim 1, wherein each of said rungs has a length generally between 18 inches and 36 inches.

5. The assembly according to claim 1, wherein each of said locking members being positioned on one of said rungs, each of said locking members including a pair of rods biased outwardly from opposite ends of a corresponding one of said rungs and into a respective one of said sets of tubular members, each of said rods being removably extendable into a next upper one of said tubular members when the next upper one of said tubular members is placed in an extended position.

6. The assembly according to claim 1, wherein said footrest is positioned nearer to said top end than said bottom end.

7. The assembly according to claim 1, further including a pair of tethers being attached to said footrest and being removably attached to said top ends such that said footrest extends outwardly from said posts, said tethers retaining said footrest in said perpendicular orientation with respect to said posts.

8. The assembly according to claim 1, further including a stabilizing member engageable with a tree and one of said rungs to stabilize said apparatus, said stabilizing member including an elongated member having a first end and a second end, said first end comprising a securing member receiving one of said rungs, a pin being removable extendable through said securing member to retain said securing member on a selected one of said rungs, an arcuate member being attached to said second end, said arcuate member being abuttable against the tree, a tie being securable to opposite ends of the arcuate member and extendable around the tree to releasably secure the arcuate member to the tree.

* * * * *